US005934324A

United States Patent [19]

Bessard

[11] Patent Number: 5,934,324

[45] Date of Patent: Aug. 10, 1999

[54] MANUAL REMOTE CONTROL DEVICE ESPECIALLY A FLUID DISTRIBUTOR

[75] Inventor: Michel Bessard, Saint-Priest, France

[73] Assignee: Mannesmann Rexroth S.A., Venissieux, France

[21] Appl. No.: 09/099,023

[22] Filed: Jun. 17, 1998

[30] Foreign Application Priority Data

Jun. 20, 1997 [FR] France ..... 97 07707

[51] Int. Cl.[6] ..... F15B 13/08

[52] U.S. Cl. ..... 137/636.2; 137/636.1

[58] Field of Search ..... 137/636.1, 636.2

[56] References Cited

U.S. PATENT DOCUMENTS 4,445,541 5/1984 Schmiel ..... 137/636.2
5,555,912 9/1996 Saadi et al. ..... 137/801

FOREIGN PATENT DOCUMENTS

WO 91/06903 5/1991 European Pat. Off. .

OTHER PUBLICATIONS

French Preliminary Search Report dated Apr. 6, 1998, French Application FR 9707707 filed Jun. 20, 1997.

*Primary Examiner*—Gerald A. Michalsky

*Attorney, Agent, or Firm*—Marshall, O'Toole, Gerstein, Murray & Borun

[57] ABSTRACT

Manually operated remote control device comprising a body (1) enclosing at least one movable member generating a signal associated with an axially movable pushrod (2) projecting upwards from the body (1); a fixing plate (3) closing the top of the body and provided with at least one drilling (5) through which the abovementioned pushrod passes; a rocking cam (6) fixed to the top of the body (1) so as to cooperate with the projecting end of the pushrod (2) and control the movement of the latter; a grip (9, 10) secured to the cam (6) and incorporating at least one electric control member (11) to which is connected an electrical cable (12) passing through the abovementioned fixing plate (3) via an opening (13) in the latter; the opening (13) is elongate and runs transversely from one edge of the plate (3), opening out into the said edge, by virtue of which the electrical cable, preassembled and pre-equipped, can be put in place in the device by being inserted into the opening transversely from the edge of the plate.

8 Claims, 1 Drawing Sheet

MANUAL REMOTE CONTROL DEVICE ESPECIALLY A FLUID DISTRIBUTOR

The present invention relates to improvements made to manually operated remote control devices comprising a body enclosing at least one movable member generating a signal when it is moved, in particular linearly parallel to the axis of the body, between two extreme positions; at least one pushrod associated with the said generating member and projecting upwards from the body, this pushrod being guided so that it is substantially axially movable; a fixing plate closing the top of the body and provided with at least one drilling through which the abovementioned pushrod passes; a rocking cam fixed to the top of the body and able to cooperate with the projecting end of the pushrod so as to control the movement of the latter; a grip secured to the cam so as to control the rocking of the latter; at least one electric control member associated with or incorporated into the grip; and at least one electrical cable linked to the said electric control member and passing through the abovementioned fixing plate via an opening in the latter.

The present invention can find application in particular, but not exclusively, in respect of the equipment of fluid distributors, in particular hydraulic manipulators, equipped with at least one ram-type pressure reducer.

On account of the plethora and diversity of controls to be performed, sometimes simultaneously, by an operator, manual remote control devices are supplemented with additional electric control members (switches, contactors, etc.) which are fixed to the operating grip of the remote control device, or else are ever more often housed inside the said grip. Since the remote control device is fixed on a support base by its fixing plate or top plate, the said plate is provided with an opening through which the electrical cable is fitted for connection thereof to other links or to electrical apparatus.

However, such an arrangement has a drawback when assembling the remote control device because the opening provided in the fixing plate is a hole which is dimensioned approximately to match the transverse dimension of the cable. Therefore, when the remote control device is put in place on its location of use, the cable must be inserted, bare, through the hole in the fixing plate and only thereafter can the cable be connected up to the requisite components. As a result it is impossible to preassemble the device fully before its installation and the cost of this installation is increased; likewise, the time and expense incurred by the refitting (dismantling followed by reassembly) of the device, during servicing, are substantial.

The objective of the invention is essentially to propose an improved arrangement of the remote control device which makes it possible to overcome the aforementioned drawbacks and allow complete preassembly of the device, including the electrical cable, resulting directly in faster and cheaper assembly and dismantling of the device.

To this end, a remote control device as mentioned in the preamble is essentially characterized, being arranged in accordance with the invention, in that the opening provided in the fixing plate for the passage of the electrical cable is an elongate opening running transversely from one edge of the said plate and opening out into the said edge.

By virtue of this arrangement the electrical cable need no longer be threaded, starting from its free end, through the passage in the plate: It is inserted transversely to the plate, starting from the edge of the latter, always in an identical manner of like duration, irrespective of the length of the cable and irrespective of its flexibility, and above all irrespective of the shape of its free end; it therefore becomes possible to pre-equip the end of the cable, for example with an electrical connector, thereby dispensing with the need to do this job in situ within a lengthier and more expensive procedure.

The elongate opening can have an approximately constant width over the whole of its length, or else preferably can be wider at its inner end than over the remainder of its length. It is conceivable, especially in the latter case, for a retaining element to be provided so as to retain the cable at the inner end of the elongate opening, this element advantageously being a bush surrounding the cable and shaped externally in accordance with the contour of the inner end of the opening.

The invention will be better understood on reading the following detailed description of certain embodiments given merely by way of non-limiting examples. In this description reference is made to the appended drawing in which.

Figure 1:
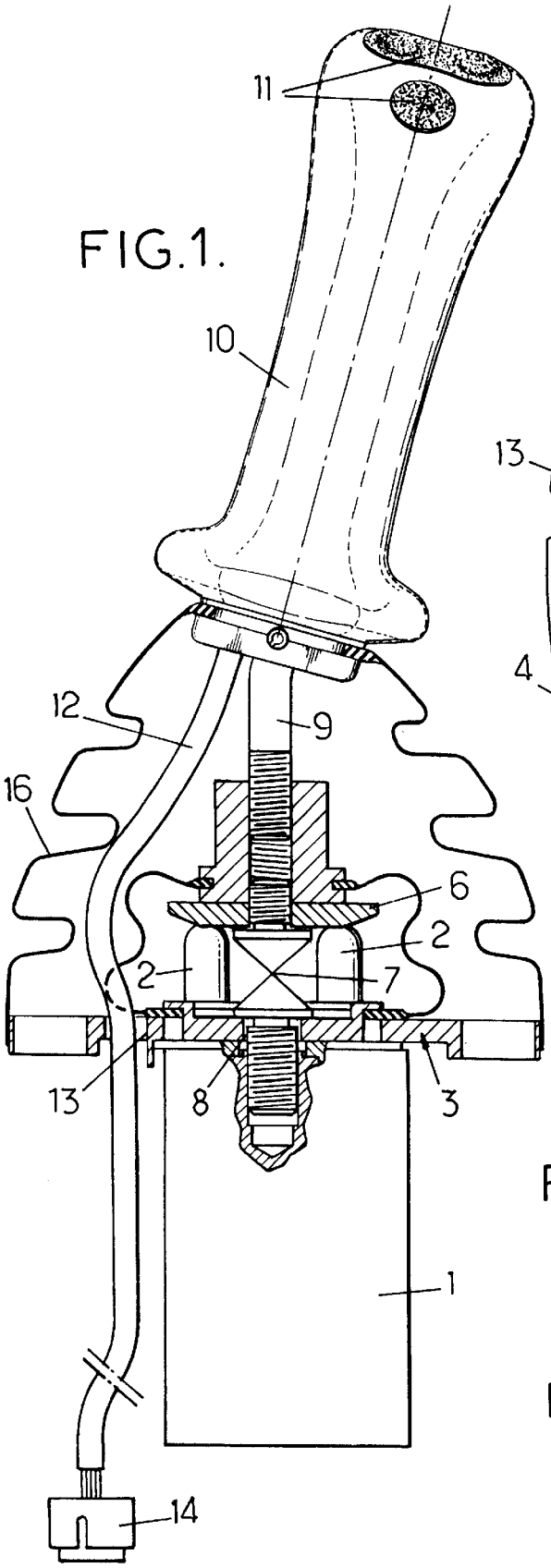
FIG. 1 is a schematic view, partially cut away, of a manual remote control device arranged in accordance with the invention.

Referring firstly to FIG. 1, this is a schematic depiction of a manually operated remote control device which can be of any type (hydraulic and/or electric and/or pneumatic) without affecting the specific provisions of the invention. By way of preferred but non-limiting application, the device is a fluid distributor, especially a hydraulic manipulator.

The device comprises a body 1 enclosing at least one movable member (not shown) generating a signal when it is moved, in particular linearly parallel to the axis of the body, between two extreme positions (this being a ram-type pressure reducer in the case of a hydraulic manipulator).

With each generating member there is associated a pushrod 2 which projects upwards from the body and which is guided so as to be substantially axially movable while engaging the generating member.

Figure 2:
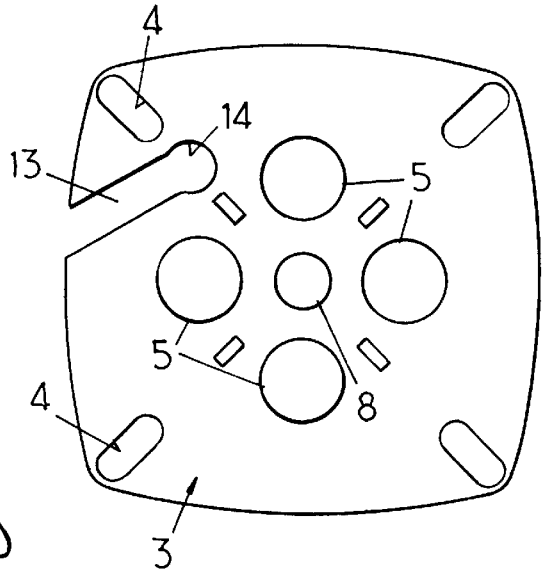
FIG. 2 is a top view of the fixing plate with which the device of FIG. 1 is equipped.

A fixing plate 3 closes the top of the body on which the former is fixed and also serves to fix the device to a support base (fixing holes 4) as illustrated in the top view in FIG. 2. The plate 3 is provided with drillings 5 through which the pushrods 2 pass (four cross-wise drillings for example for a remote control device with four lead-outs).

A rocking cam 6 is fixed to the top of the body via a toggle or cardan joint 7 itself screwed centrally into the body 1 via a central drilling 8 in the plate 3 (fixing the plate 3 to the body 1). The cam 6 cooperates with the upper end of the pushrods 2 for selective control of their downward travel in accordance with the sense thereof and amplitude of tilt thereof.

Fixed on the cam 6 is a stem 9 surmounted by a grip 10 which makes it possible to control the tilt of the cam. One or more electric control members 11 such as switches, contactors, etc. are placed on the stem 9 or the grip 10, or in the grip 10 (as illustrated).

One or more electrical cables 12 from these electric control members run from the grip 10 and pass through the fixing plate 3 via an opening 13. In the example illustrated, the cable leaves, under the plate 3, outside the body 1 and is equipped, at its free end, with an electrical connector 14 allowing fast connection and disconnection thereof.

In accordance with the invention, the opening 13 provided for the cable 12 in the fixing plate 3 is not a straightforward through-hole but takes the form of an elongate opening running transversely from one edge of the plate 3 and opening out into the said edge as shown in FIG. 2.

In the example illustrated in FIG. 2, the elongate opening 13 has an approximately constant width over the whole of its length, which width is determined as a function of the transverse dimension of the cable 12, and its back 14 is rounded.

Figure 3:
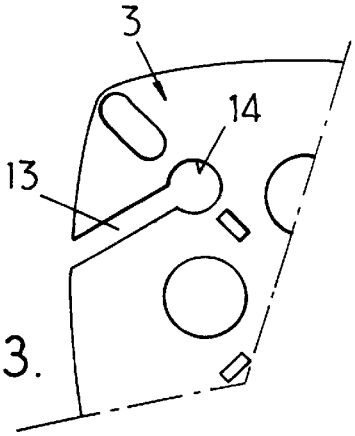
FIG. 3 is a partial top view of a variant of the plate of FIG. 2.

It is likewise conceivable, as illustrated in FIG. 3, for the elongate opening 13 to be wider at its inner end 14, shaped in the form of an arc of a circle, than the remainder of its length: The cable 12 then has to be flattened so that it can be inserted as far as the back 14 of the opening, or else it must be made as several bundles each having a transverse dimension which individually matches the narrow width of the opening 13. The cable 12 is thus more easily retained at the back 14 of the opening 13.

Figure 4:
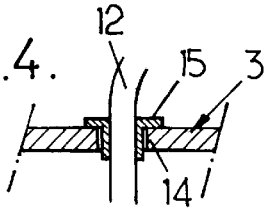
FIG. 4 is a partial cut-away side view of the plate of FIG. 1 illustrating a particular item of equipment.

However, if necessary it is possible to provide an extra element for retaining the cable 12 at the back of the opening 13: This may, as illustrated in FIG. 4, be a bush or a sleeve 15 surrounding the cable and shaped externally according to the contour of the back 14 of the opening 13 so that it may be wedged therein.

However, it should be noted that even in the absence of a retaining piece 15, irrespective of the shape thereof, the cable 12 cannot become dislodged from the opening 13 on account of the presence of a sealing bellows 16 which peripherally surrounds the plate 3 and closes the opening 13.

As is self-evident and as already follows from the foregoing, the invention is in no way limited to those of its modes of application and embodiments which have more particularly been conceived; on the contrary it embraces all variants thereof.

What is claimed is:

1. Manually operated remote control device comprising a body (1) enclosing at least one moveable member generating a signal when it is moved, in particular linearly parallel to the axis of the body, between two extreme positions; at least one pushrod (2) associated with the said generating member and projecting upwards from the body (1), this pushrod (2) being guided so that it is substantially axially moveable; a fixing plate (3) closing the top of the body and provided with at least one drilling (5) through which the abovementioned pushrod passes; a rocking cam (6) fixed to the top of the body (1) and able to cooperate with the projecting end of the pushrod (2) so as to control the movement of the latter; a grip (9, 10) secured to the cam (6) so as to control the rocking of the latter; at least one electric control member (11) incorporated into the grip (10); and at least one electrical cable (12) linked to the said electric control member (11) and passing through the abovementioned fixing plate (3) via an opening (13) in the latter, characterized in that the opening (13) provided in the fixing plate (3) for the passage of the electrical cable (12) is an elongate opening running transversely from one outer edge of the said plate (3) and opening out into the said edge, by virtue of which the preassembled and preequipped electrical cable can be put in place in the device by being inserted into the opening transversely from the outer edge of the plate.

2. Remote control device according to claim 1, characterized in that the elongate opening (13) has an approximately constant width over the whole of its length.

3. Remote control device according to claim 1, characterized in that the elongate opening (13) is wider at its inner end (14) than over the remainder of its length.

4. Remote control device according to claim 3 characterized in that a retaining element is provided in order to retain the cable at the inner end of the elongate opening, and in that the retaining element is a bush surrounding the cable and is shaped externally in accordance with the contour of the inner end of the opening.

5. Remote control device according to claim 1, characterized in that a retaining element is provided in order to retain the cable at the inner end of the elongate opening.

6. Remote control device according to claim 1, characterized in that the inner end of the elongate opening has a contour in the shape of an arc of a circle.

7. Remote control device according to claim 1, characterized in that the elongate opening is closed by a bellows peripherally surrounding the plate.

8. A hydraulic manipulator comprising a remote control device in accordance with claim 1.

* * * * *